United States Patent [19]

Ury

[11] 4,359,668

[45] Nov. 16, 1982

[54] METHOD AND APPARATUS FOR IGNITING ELECTRODELESS DISCHARGE LAMP

[75] Inventor: Michael G. Ury, Bethesda, Md.

[73] Assignee: Fusion Systems Corporation, Rockville, Md.

[21] Appl. No.: 283,701

[22] Filed: Jul. 15, 1981

Related U.S. Application Data

[63] Continuation of Ser. No. 20,457, Mar. 14, 1979.

[51] Int. Cl.[3] ..... H01J 7/46; H01J 19/80

[52] U.S. Cl. ..... 315/39; 250/372; 250/504 R; 315/267; 315/248; 315/344

[58] Field of Search ..... 315/39, 248, 267, 344; 313/54; 250/372, 373, 504

[56] References Cited

U.S. PATENT DOCUMENTS

| | | | |
|---|---|---|---|
| 3,609,448 | 9/1971 | Williams | 315/39 |
| 3,641,389 | 2/1972 | Leidigh | 315/39 |
| 3,648,100 | 3/1972 | Goldie et al. | 315/39 |
| 3,705,319 | 12/1972 | Goldie et al. | 315/39 |
| 3,872,349 | 3/1975 | Spero et al. | 315/39 |
| 3,911,318 | 10/1975 | Spero et al. | 315/39 |
| 4,001,632 | 1/1977 | Haugsjaa et al. | 315/39 |
| 4,041,352 | 8/1977 | McNeill et al. | 315/248 |
| 4,053,814 | 10/1977 | Regan et al. | 315/248 |
| 4,185,228 | 1/1980 | Regan | 315/39 |

*Primary Examiner*—Saxfield Chatmon, Jr.
*Attorney, Agent, or Firm*—Pollock, Vande Sande & Priddy

[57] ABSTRACT

A method and apparatus for igniting a microwave generated discharge lamp. An ultraviolet-producing means is positioned so as to irradiate the fill-containing envelope of the discharge lamp. The ultraviolet-producing means is excited by microwave energy which is extracted from means which couples microwave energy from the microwave source to the fill-containing envelope of the discharge lamp.

9 Claims, 1 Drawing Figure

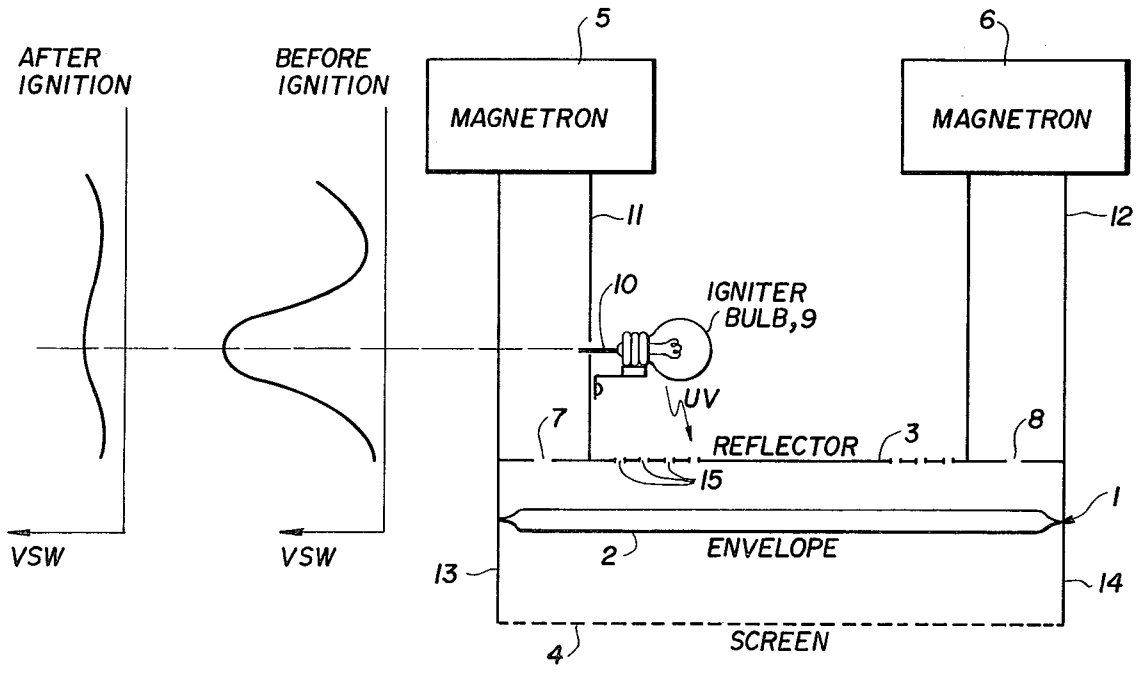
MAGNETRON
MAGNETRON
IGNITER BULB,9
UV
REFLECTOR
ENVELOPE
SCREEN
BEFORE IGNITION
AFTER IGNITION
VSW
VSW
1
2
3
4
5
6
7
8
10
11
12
13
14
15

METHOD AND APPARATUS FOR IGNITING ELECTRODELESS DISCHARGE LAMP

This is a continuation of application Ser. No. 20,457, filed Mar. 14, 1979.

The present invention is directed to a method and apparatus for igniting a microwave generated plasma discharge lamp.

In general such lamps are comprised of a light transmissive envelope containing a plasma-forming medium, a microwave source means, and coupling means for coupling energy from the microwave source means to the envelope to excite a plasma which emits a light discharge.

In order to initiate breakdown in such lamps, some form of external radiation must be incident on the fill-containing envelope. This radiation causes an initial electron to become free from an atom, the initial electron bombards other atoms and causes other electrons to be freed, and an avalanche effect follows, thus causing the discharge.

Stray or cosmic radiation, which is always present in the atmosphere will be incident on the fill-containing envelope, and will cause the initial breakdown. However, the occurrence of this radiation is quite random, and it may take several seconds for the lamp to ignite if such radiation is relied on. Hence, when reliable instantaneous starting is required, an auxiliary source of radiation such as an ultraviolet light source is usually used.

In general, the prior art ignition systems using such ultraviolet or other radiation sources are rather complicated, and usually involve circuitry involving switching and/or timing components. In some prior art systems, a separate power supply for the igniter bulb is required.

In distinction to the prior art, the present invention provides a simple and reliable igniter method and apparatus which utilizes no additional power supply, no switches, and no circuitry. It is inexpensive to manufacture, and if and when failure occurs, it is easily replaced.

It is thus an object of the invention to provide a method and apparatus for igniting a microwave generated plasma discharge lamp, which is simple and reliable.

It is a further object of the invention to provide a method and apparatus for igniting a microwave generated plasma discharge lamp which involves no switching means, no timing means, and no circuitry.

It is still a further object of the invention to provide a method and apparatus for igniting a microwave generated plasma discharge lamp which utilizes only a few parts, and which is simple and inexpensive to manufacture.

The above objects are accomplished by extracting microwave energy from the coupling means which couples such energy from the microwave source to the fill-containing envelope of the discharge lamp. The extracted energy is coupled to an ultraviolet source, the light emitted by the source being incident on the fill-containing envelope, thus ionizing the fill and igniting the discharge. As soon as the discharge begins, the amplitude of the voltage standing wave in the microwave coupling means is greatly reduced and the ultraviolet producing source automatically extinguishes or if it continues to operate, does so at a greatly reduced output.

The invention will be better understood by referring to the accompanying drawing in which:

The FIGURE is a pictorial illustration of an embodiment of the invention in conjunction with an explanatory graphical diagram.

Referring to the FIGURE, microwave generated plasma light source 1 is shown. As mentioned above, in general such a source is comprised of a plasma forming medium-containing light transmissive envelope, a microwave source means, and a means for coupling the microwave energy from the source means to the envelope.

The method and apparatus of the invention may be used to ignite any arbitrary type of microwave generated electrodeless light source so long as the microwave source, microwave coupling means, and fill-containing envelope are present. For instance, the envelope can be of any desired shape and the coupling means can be a waveguide, coaxial structure or other microwave coupler. However, for purposes of illustration, the invention will be described in conjunction with a specific electrodeless light source manufactured by Fusion Systems Corporation and shown in the pictorial form in the FIGURE.

Referring to the FIGURE, the light source depicted utilizes an elongated plasma forming medium-containing envelope 2 which is made of quartz so as to be transmissive to ultraviolet light. The envelope 2 is filled with an appropriate mixture of gases as known to those skilled in the art, for instance, including argon and mercury. The bulb 2 is disposed in a microwave chamber comprised of elliptical reflector 3, wire mesh 4 which seals the bottom of the elliptical reflector, and end members 13 and 14. The mesh 4 is of such dimension so as to keep microwave energy within the chamber while allowing ultraviolet light to exit therefrom. The reflector has a plurality of cooling holes 15 disposed along its top.

Waveguides 11 and 12 are mounted on opposite ends of reflector 3 and coupling slots 7 and 8 in the reflector permit effective coupling from the respective waveguides to the microwave chamber. Magnetrons 5 and 6 are mounted on waveguides 11 and 12 respectively, so that microwave energy generated by the magnetrons is coupled to the microwave chamber via the waveguides 11 and 12 and coupling slots 7 and 8. The microwave energy in the chamber is incident on plasma forming medium-containing envelope 2.

As mentioned above, external radiation is needed to cause initial ionization which allows plasma formation. According to the invention, an ultraviolet-producing bulb 9 is provided and is positioned so that energetic photons emitted from it are incident on envelope 2. For the particular discharge lamp shown, the radiation is fed through cooling holes 15 in the elliptical reflector.

Microwave radiation is extracted from waveguide 11 and is coupled directly to bulb 9 to cause the bulb to become excited and emit ultraviolet light. In the embodiment of the invention shown, the microwave energy is extracted from the waveguide by probe means 10 which is connected to one end of the filament of light source 9. The other end of the filament is grounded to the waveguide. The probe 10 is insulated from the surface of the waveguide. In accordance with the invention, microwave energy may be extracted by other means also, for instance by a magnetic coupling loop. As described below, the probe or loop is situated close to a standing wave maximum which exists prior to ionization.

As soon as ultraviolet radiation from bulb 9 strikes envelope 2, the fill ionizes and discharge occurs. This causes the amplitude of the voltage standing wave in waveguides 11 and 12 to become substantially reduced, thus either extinguishing bulb 9 or substantially reducing its output. Thus bulb 9 is automatically turned off without the use of switches or timing circuitry, and is only on at full output for a very short period of time, thus increasing the bulb life.

Many different specific bulb types will operate in the apparatus of the invention. For example, bulbs filled with a noble gas, a mixture of noble gases, and noble gases with traces of mercury vapor are all conceptually sound. However, a substantial amount of experimenting was done to find a bulb which would operate reliably over a long term, and it was found that the General Electric type G4-S11 quartz ozone germicidal lamp provided the reliability needed.

It is preferable to locate the probe at a position corresponding to a maximum of the voltage standing wave in waveguide 11. This will insure the highest percentage reduction in the amplitude of the standing wave after ignition, thus insuring that the bulb is either extinguished or that its output is reduced as much as possible. The reduction in the amplitude of the standing wave may be seen by referring to the graphical part of the FIGURE, wherein it is seen that probe 10 is located at a standing wave maximum.

Since the magnitude of the energy which is coupled to bulb 9 is dependent upon the depth of probe 10 in the waveguide, to achieve reliable long-term operation, the length of the probe must be carefully selected. It should be chosen so that the signal coupled is large enough to illuminate the bulb but not so large as to burn it out, and not so large so that the bulb does not extinguish or have its output greatly reduced upon ignition of discharge lamp 1. For any given bulb type, the correct probe length and position in the waveguide with respect to the standing wave pattern should be determined by experimentation.

It is to be understood that a single embodiment of the invention has been illustrated and that it is applicant's intention to cover all modifications which come within the spirit and scope of the invention, which is to be limited only by the claims appended hereto.

What is claimed is:

1. Apparatus for igniting a microwave generated light source which is comprised of a plasma forming medium-containing envelope made of a transparent material, microwave source means, and microwave coupling means for coupling the microwave energy emitted by said source means to said envelope comprising, ultraviolet source means for emitting ultraviolet light when excited, means for extracting microwave energy from said microwave coupling means and for coupling it to said ultraviolet source means to excite said ultraviolet source means, said ultraviolet source means being positioned so as to irradiate said envelope with said emitted ultraviolet light, thus causing ignition of the plasma forming medium in said envelope.

2. The apparatus defined in claim 1 wherein said microwave energy is extracted at or very close to a maximum of the standing wave in said coupling means.

3. The apparatus defined in claim 2 wherein said microwave coupling means comprises a waveguide.

4. The apparatus defined in claim 3 wherein said means for extracting and coupling comprises a probe means.

5. The apparatus defined in claim 4 wherein said ultraviolet source means comprises a light bulb having a filament, and wherein said probe means is connected to said filament.

6. A method of igniting a microwave generated light source which is comprised of a plasma forming medium-containing envelope made of a transparent material, microwave source means, and microwave coupling means for coupling the microwave energy emitted by said source means to said envelope, comprising the steps of, positioning an ultraviolet source means so that when excited it will irradiate said envelope with ultraviolet light, and extracting microwave energy from said microwave coupling means and coupling it to said ultraviolet source means to excite the source means.

7. The method of claim 6 wherein said microwave coupling means comprises a waveguide.

8. The method of claim 7 wherein said microwave energy is extracted from said waveguide at or close to a maximum of the standing wave in the waveguide.

9. Apparatus for igniting a microwave generated light source comprising, a plasma forming medium-containing envelope made of a transparent material, microwave source means, ultraviolet source means for emitting ultraviolet light when excited, means for coupling microwave energy which is emitted by said microwave source means to said plasma forming medium-containing envelope and to said ultraviolet source means for exciting it, said ultraviolet source means being positioned so as to irradiate said envelope with said emitted ultraviolet light, thus causing ignition of the plasma forming medium in said envelope.

* * * * *